United States Patent [19]

Barbery et al.

[11] Patent Number: 4,822,493

[45] Date of Patent: Apr. 18, 1989

[54] METHOD FOR SEPARATION OF COARSE PARTICULES

[75] Inventors: Gilles Barbery; Ahmed Bouajila; Heriban Soto, all of Quebec, Canada

[73] Assignee: Universite Laval, Cite Universitaire, Quebec, Canada

[21] Appl. No.: 125,709

[22] Filed: Nov. 27, 1987

[51] Int. Cl.[4] ..... B03D 1/12

[52] U.S. Cl. ..... 210/703; 209/164; 209/170; 209/165; 210/221.2

[58] Field of Search ..... 209/162–164, 209/170, 165; 210/703, 207, 221.1, 221.2

[56] References Cited

U.S. PATENT DOCUMENTS 3,298,519 1/1967 Hollingsworth ..... 209/165
3,574,331 4/1971 Kurosawa et al. ..... 210/221.1 X
3,730,341 5/1973 Mames et al. ..... 209/164
4,639,313 1/1987 Zipperian ..... 209/170
4,722,784 2/1988 Barnscheidt ..... 209/164

*Primary Examiner*—Charles Hart
*Attorney, Agent, or Firm*—Nixon & Vanderhye

[57] ABSTRACT

The disclosure herein describes a method for the separation of hydrophobic from hydrophilic materials in a liquid suspension by means of gas bubbles and a flow of water that drags the hydrophobic material upwards. A distinctive feature of the method is an upward flow of water countercurrent to the flow of settling hydrophilic particles. The disclosure describes a cell in which gas is caused to disperse into an ascending flow of liquid and in which a feed port is provided to introduce particles in a flow countercurrent to that of the bubbles and water.

6 Claims, 3 Drawing Sheets

METHOD FOR SEPARATION OF COARSE PARTICULES

FIELD OF THE INVENTION

The present invention pertains to froth flotation to separate coarse particles.

BACKGROUND OF THE INVENTION

Conventional froth flotation is not efficient to separate coarse particles. In industrial practice, sulphide particles, for example, larger than about 0.3 mm (a weight of the order of 0.1 mg) are very difficult to recover. In non-metallic flotation, under the most favourable conditions, the upper limit of froth flotation is about 1 mm which corresponds to particle weight of 1–2 mg.

A limited number of studies has been devoted to the problem of coarse particle flotation. Most researches have been limited to the problem of beneficiation of very fine particles and there is little substantial understanding of the flotation behavior of coarse particles. Obviously, the low floatability of large particles is somehow related to the extra weight that has to be lifted to the surface (usually under highly turbulent conditions) and then transferred and maintained in the froth layer. Factors, such as density of the solid, turbulence, stability and height of the froth layer, tenacity of the particle-bubble attachment, depth of the water column, and other variables that can indirectly influence the factors listed above, determine the floatability of coarse particles.

To analyse the floatability of coarse particles, it is convenient to consider each one of the successive steps required to accomplish flotation: collision, adhesion, formation of an aggregate stable in the hydrodynamic system, levitation, transfer to the froth phase and finally permanence in the froth phase. One or more of these steps can be a limiting factor in the flotation of coarse particles.

All theoretical and experimental data indicate that the collision efficiency is favored by increasing particle size, so this factor can be discarded as a serious limitation to the recovery of coarse particles.

The probability of adhesion (or attachment) is determined by the surface hydrophobicity and by the induction time. Hydrophobicity should not be affected by the particle size and it is clear that highly hydrophobic coatings (contact angles of 50–60 degrees or more) can be obtained with conventional flotation reagents. On the other hand, some authors have proposed an increase in induction time (therefore, a decreased adhesion) with increasing particle size, but no explanation is offered about the reasons for such an increase. There is also reports derived from theoretical models that indicate that increasing the bubble size decreases the efficiency of collection.

According to theoretical developments, the floatability of particles is determined by the balance of the forces acting on the particle-bubble aggregate including: weight in the gravitational field, buoyancy, hydrostatic pressure, and capillary, tension, compression and shear forces prevailing in the hydrodynamic system. In the absence of turbulence, particles much larger than 1.0 mm should float if the contact angle is 50–60 degrees. In a turbulent field, the upper grain size limit in flotation would be reached when the kinetic energy of the particle (determined by its velocity and weight) is larger than the energy required for detachment. For a given contact angle, the upper floatable size limit would be drastically reduced in a turbulent field to one half or less than the equivalent value under quiescent condition. There is some experimental evidence that supports this turbulence determined disruption mechanism.

Once a stable particle-bubble aggregate is formed, under quiescent conditions, the flotation of large particles is limited by the buoyancy factor. A simple geometrical calculation shows that this factor is strongly dependent on bubble size. Large particles cannot be levitated by small bubbles such as those prevailing in agitated mechanical cells. It is reported that the average bubble size in most mechanical cells is about 0.5 mm. The buoyancy of spherical bubble of this size in water is just 0.065 mg.. Therefore, to float a particle of say 24 mg. (i.e. a 2.0 mm cubic particle of density 3.0 and actual weight in water of 16 mg.), the attachment of at least 247 bubbles would be necessary; this is physically impossible since, on the 24 $mm^2$ of surface available, only about hundred 0.5 mm could be packed. On the other hand, 2.0 mm bubbles have a buoyancy of 4.18 mg.. While the particle could accommodate up to six such bubbles on its surface, just four bubbles are required for levitation. It seems clear from this analysis that any attempt to improve coarse particles flotation should address the problem of stabilizing bubbles larger than those obtained in conventional flotation machines. Regarding the transfer of the particles to the froth phase and their stability in the froth bed, it has been suggested that coarse particles destabilize the froth and it is well established that coarse particles drain back to the cell faster than small particles.

Conventional mechanical flotation cells are required to perform two inherently contradictory tasks: first to provide enough agitation to create the turbulence level necessary to suspend the particles, disperse the air and promote the subsequent bubble-particle collision and, secondly, to provide quiescent hydrodynamic conditions to avoid disruption of the particle-bubble aggregate and also avoid the transfer of gangue to the froth layer. These tasks can be accomplished fairly well by most mechanical cells when not too coarse or not too fine particles are treated. However, when the flotation of coarse particles is intended, a higher level of turbulence is required to keep the particles from settling; but, at the same time, less turbulence is required to stabilize larger bubbles and to account for the larger inertial forces that can more easily disrupt the particle-bubble aggregate.

Non-mechanical cells present the advantage of lower turbulence which implies a more stable particle-bubble aggregate and the possibility of larger bubbles. However, the transfer of particles to a froth phase remains a problem, particularly in column-type cells where the wash water flow is likely to be an additional barrier for coarse particle recovery. One solution to the problem of transfer to a froth bed is the skin flotation method as practiced in different variations in phosphate rock processing. This method, however, presents the inconvenience of low capacity and difficult control.

SUMMARY OF THE INVENTION

From the discussion presented above, at least three factors that should be incorporated in new devices for coarse particle flotation can be identified. In the first place, the transfer step from the water phase to a froth phase could be eliminated. A frothless flotation could be achieved by elutriation of the bubble-particle aggregate with an upwards flow of water. The second feature desirable in a flotation cell for coarse particles is a low turbulence regime to avoid the disruption of the bubble-particle aggregate, allow bubble growth and minimize the attritioning of the softer minerals. In this regard, mechanical cells seem out of the question because they can not keep the pulp in suspension and, at the same time, provide a quiescent hydrodynamic system. Quiescent conditions are also required for the third feature necessary in a coarse particles flotation cell: an ample supply of relatively large bubbles.

The present invention therefore relates to a flotation method and apparatus that combine the requirements mentioned above.

A distinctive feature of this invention is an upwards flow of water countercurrent to the particles flow instead of the co-current flow featured by conventional columns. The apparatus of the present invention maintains most of the advantages of a flotation column and is more appropriate for the flotation of coarse feeds. A froth layer and actual levitation of the particles is not required; the bubble-particle aggregate is dragged or elutriated by the flow of water. In addition to improving recovery of coarse particles, this type of separation requires less reagents than conventional flotation.

The present invention allows the separation of hydrophobic from hydrophilic materials in a liquid suspension by means of gas bubbles and a flow of water that drags the hydrophobic material that looses at least part of its weight through the attachment of gas bubbles. Therefore, this invention is similar to conventional flotation since it takes advantage of the attachment of gas bubbles onto solids to make them float. However, it differs from conventional froth flotation in that, neither total buoyancy nor actual transfer to a froth layer are necessary. Particle-bubble aggregates heavier than water are elutriated by the flow of liquid.

In conventional froth flotation, large particles, even if attached to several bubbles, may still be heavier than the liquid and, therefore, they would not ascend up to the surface. In other cases, even if enough buoyancy is provided by the attached bubbles, particles may be to heavy to be sustained in the froth; in either case, these particles would not be recovered by froth flotation. On the other hand, with the present invention, just a partial buoyancy should be sufficient to allow the elutriation of these particles by a flow of water.

An obvious limitation of this method is that the weight of the hydrophilic particles should be higher than the drag force of the liquid flow.

The separation described in this invention can be performed in an apparatus resembling any of the different types of cells (mechanical, columns, pneumatics etc.) used in froth flotation of ores, but with the modifications necessary to provide an upwards flow of water. In essence, the apparatus has the means to disperse gas into an ascending flow of liquid and a feed port located at a certain distance from both the top and the bottom of the cell in such a way that the ascending liquid and bubbles flow countercurrent to the settling solid particles.

Other objects and further scope of applicability of the present invention will become apparent from the detailed description given hereinafter. It should be understood however, that this description, while indicating preferred embodiments of the invention, is given by way of illustration only since various changes and modification within the spirit and scope of the invention will become apparent to those skilled in the art.

DESCRIPTION OF PREFERRED EMBODIMENTS

Figure 1:
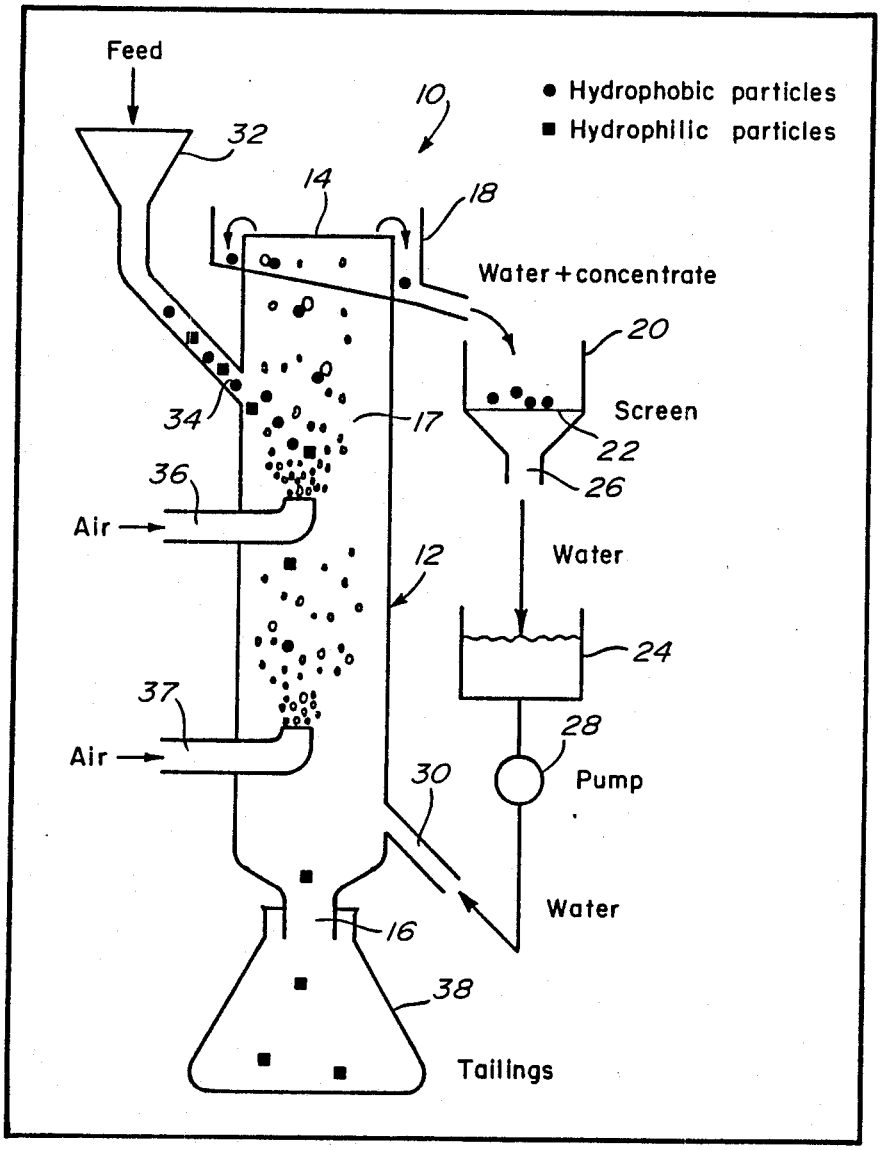
FIG. 1 is a schematic representation of a flotation column adapted to carry out the method of the present invention.

Referring to FIG. 1, there is shown a flotation column, generally designated 10, which includes a cylindrical body 12 having a top 14 and a bottom 16 and defining a chamber containing a liquid suspension 17. A collecting device 18 directs water and concentrate to a recipient 20 having a screen 22 to separate the concentrate from the water which is then collected in a lower recipient 24 through an outlet 26. A pump 28 serves to introduce in body 12 through an inlet port 30 at the bottom of the body 12 water collected from recipient 24.

Comminuted materials are fed from a hopper 32 through an inlet port 34 at the top of the body 12. Two gas inlet tubes 36 and 37 extend in the liquid solution 17 to disperse gas bubbles therein.

A recipient 38 serves to receive the tailings at the bottom 16 of the chamber.

The method of the present invention consists in feeding through port 34, into the water filled body 12, hydrophobic particles (represented by black dots) and hydrophilic particles (represented by black squares). Pump 28 is operated to cause an upwards flow of liquid in the chamber. Compressed air injected into the inlet tubes 36 and 37 forms bubbles in the liquid solution in a flow which is co-current with the ascending liquid but which is countercurrent to the solid particles settling in the recipient 38.

The hydrophobic particles are raised to the top of the chamber due to buoyancy. Large particles, even attached to bubbles, may still be heavier than the liquid. However, these particles are moved upwards in the chamber due to the upwards flow of liquid originating from port 30; hence, only a partial buoyancy is sufficient to allow their elutriation. Hydrophilic particles (and hydrophobic particles having a weight greater than the drag force of the liquid flow) are collected in the bottom recipient 38 or washed away in any conventional manner.

EXAMPLE 1

A prototype cell, as the one shown in FIG. 1, was constructed with a glass tube of 2.86 cm. internal diameter and a total height of 52 cm.. The active flotation zone, i.e. below the feed port and above the lower gas diffuser, was 24.5 cm.. The "cleaning zone", i.e. above the feed port, was 17 cm tall. A pure, coarse quartz sample (99.9% insoluble in acid) was floated in this apparatus as a function of water and feed flow rates. The particle size distribution of the quartz used in shown in Table 1. Before feeding, 200 g of quartz were conditioned at 66% solids with 250 g/ton Armac T (an amine collector) and 250 g/ton kerosene during 30 sec..

One liter of water containing 50 mg/l Aerofroth (Trademark) was circulated through the cell at various flow rates while the air flow rate was kept constant at 62 cm/min.

Figure 2:
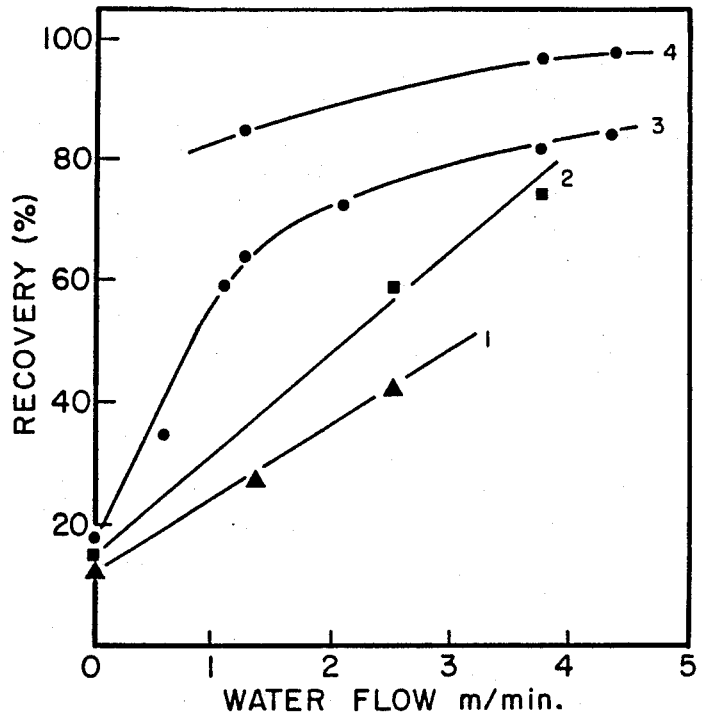
FIG. 2 is a graph providing the effect of water flow rate on quartz recovery.
Figure 3:
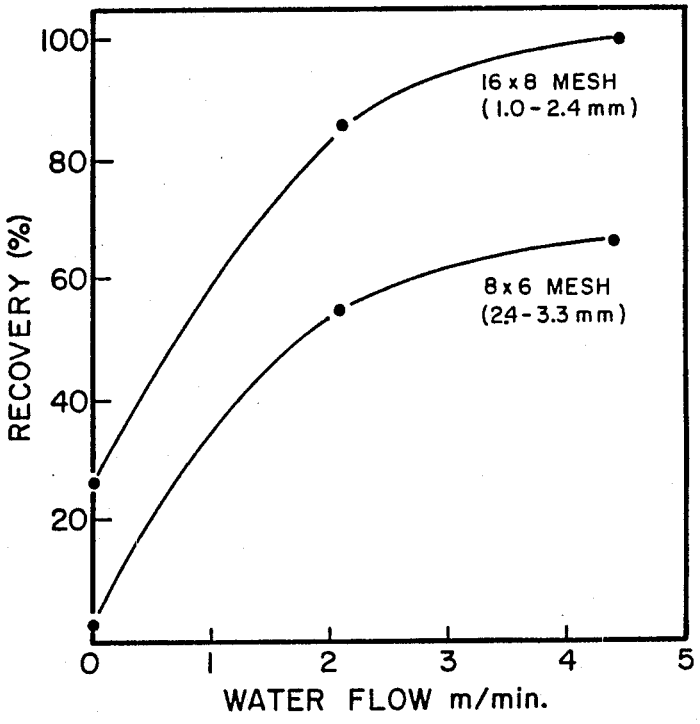
FIG. 3 is a graph showing quartz recovery of two size fractions for the flotation data shown in curve 3 of FIG. 2.

As shown in Table 2, when no collector was added, elutriation of the hydrophilic quartz particles was negligible. Only the very small particles were dragged at the highest water (and bubbles) velocity tested. On the other hand, in the presence of collector, an increase in the water flow rate resulted in a dramatic increase of recovery. (see FIGS. 2 and 3). Particles as large as 8 mesh (2.36 mm) floated up to 100% in a single stage with moderate water flowrates. More than 80% overall recovery was obtained in a single stage, only the heaviest particles settled to the bottom of the cell but many particles larger than 3 mm and weighing more than 70 mg each were recovered. By recycling the tailings of the first stage practically a 100% recovery was obtained at the highest flow rate. It should be noted that, in the small apparatus used, the "active" zone was only 24.5 cm; thus, the residence time of the coarser particles was at most a few seconds, unless its settling velocity was slowed down by bubble attachment. This is probably the reason for the decreased recoveries observed when the feed rate was increased. Therefore, a taller active zone is likely to yield better results than those given in FIGS. 2 and 3.

Without a positive water flow, recovery of particles larger than about 1.4 mm (weighing 2–3 mg) was negligible. This is in agreement with the well known limitation of conventional froth flotation. These results demonstrate the feasibility of levitating particle-bubble aggregates by the drag force of a liquid flow.

EXAMPLE 2

A 1:1 mixture of quartz and calcite was floated as in Example 1 at a feed rate of 3 Kg/hr. The particle size distribution of the minerals is given in Table 1. The mixture analyzed 50.3% insoluble (i.e. calcite was 99.4% soluble). Results obtained with 0.125 g/ton Armac T (trademark) and the same amount of kerosene are shown in Table 3. It is seen here that quartz recovery increased drastically from 20.2 to 88.9% when a flow rate of 2.5 m/min was used. Selectivity was not affected markedly although the finer calcite particles tended to float particularly if the collector doses was increased. This indicates that the collector used was not very selective for this mineral system. Nevertheless, a 95.6% quartz concentrate was obtained for a recovery of 88.9%.

EXAMPLE 3

The same mixture of Example 2 was floated as before, but using lauric acid to float calcite instead of the amine flotation of quartz. The collector doses was increased to 2 Kg/ton and the pH was increased from neutral to 8.7. Results obtained are given in Table 4. Excellent recovery and grade were obtained by increasing the water flowrate from 0 to 5.6 m/min. The separation obtained was nearly quantitative. Only a few very coarse grains of calcite weighing up to more than 130 mg each remained in the tailings, while in the concentrate a few very fine quartz particles were evident.

It is to be noted that the particle size range used in these examples is much broader than normally found in conventional froth flotation where the difference in particle size between the largest and smallest particles treated is at most about 0.5 mm (i.e. maximum 1–2 mg difference between the heaviest and lightest particles treated). These examples show that with moderate water flows the maximum particle weight that can be floated increases by at least an order of magnitude as compared with conventional froth flotation.

TABLE 1

Particle size distribution of minerals.

| SIZE | | QUARTZ | CALCITE |
|---|---|---|---|
| MM | MESH | % | % |
| 2.36–3.33 | 6 × 8 | 47.1 | 80.6 |
| 1.41–2.36 | 8 × 12 | 40.4 | 13.1 |
| 1.0–1.41 | 12 × 16 | 11.2 | 5.6 |
| −1.0 | −16 | 1.3 | 0.7 |

TABLE 2

Quartz recovery as a function of water flowrate without collector addition. Frother concentration 50 mg/l.

| FLOWRATE (m/min) | RECOVERY (%) |
|---|---|
| 0.0 | 0.0 |
| 1.25 | 0.0 |
| 2.50 | 0.0 |
| 3.75 | 0.1 |
| 4.35 | 0.6 |

TABLE 3

Recovery and grade of quartz floated from a 1:1 mixture with calcite.

| WATER FLOWRATE (m/min) | RECOVERY % | GRADE % quartz | TAILINGS % soluble |
|---|---|---|---|
| 0.0 | 20.2 | 98.0 | 55.3 |
| 2.5 | 88.9 | 95.6 | 86.4 |

TABLE 4

Recovery and grade of calcite floated from 1:1 mixture with quartz.

| WATER FLOWRATE (m/min) | RECOVERY % | GRADE % calcite | TAILINGS % insoluble |
|---|---|---|---|
| 0.0 | 22.6 | 99.5 | 56.4 |
| 2.8 | 55.7 | 99.6 | 69.3 |
| 5.6 | 81.4 | 98.7 | 82.9 |
| 5.6* | 93.3 | 98.3 | 93.5 |

*Non floated material was fed a second time through the column.

The embodiments of the invention in which an exclusive property or privilege is claimed are defined as follows:

1. A method for the separation of particles in a liquid suspension, said method comprising the steps of:

injecting gas bubbles into said liquid suspension under conditions which avoid the formation of a froth phase to form particle-bubble aggregates including aggregates heavier than water;

introducing an upward flow of liquid through said suspension under conditions of low turbulence so that said liquid and said gas bubbles ascend countercurrent to settling particles without disrupting said bubble-particle aggregates; and elutriating particle-bubble aggregates heavier than water by upwards flow of liquid and bubbles.

2. A method as defined in claim 1, wherein the flow of liquid is from about 0.1 to 10 m/min.

3. A method as defined in claim 1, further comprising the step of adding reagents for selectively rendering particles hydrophobic.

4. A method as defined in claim 1, wherein said liquid is water.

5. A method as defined in claim 1, wherein said gas is air.

6. A method for the separation of hydrophobic particles from hydrophilic particles in a liquid suspension, said method comprising the steps of:

providing a flotation column containing said liquid suspension, said column having an upper part and a bottom and a feeding port for supplying hydrophilic and hydrophobic particles into said column;

injecting gas bubbles into said liquid suspension under conditions which avoid the formation of a froth phase to form particle-bubble aggregates including aggregates heavier than water;

introducing in said column an upwards flow of liquid in a direction co-current with the flow of gas bubbles but countercurrent to settling solid hydrophilic particles, said upwards flow of liquid being introduced under conditions of low turbulence so that said liquid and said gas bubbles ascend countercurrent to settling particles without disrupting said bubble-paticle aggregates; and elutriating hydrophobic particles heavier than water by upwards flow of liquid and bubbles, said hydrophobic particles being elutriated at the upper part of the column while said hydrophilic particles are collected at the bottom of said column.

* * * * *